US006061910A

United States Patent [19]

Williamson

[11] Patent Number: 6,061,910

[45] Date of Patent: May 16, 2000

[54] FRAMING STUD AND METHOD OF MAKING THE SAME

[76] Inventor: Steve Williamson, 855 Summit St., Findlay, Ohio 45840

[21] Appl. No.: 09/203,198

[22] Filed: Nov. 30, 1998

[51] Int. Cl.[7] ..... B23P 19/02

[52] U.S. Cl. ..... 29/897.312; 29/432; 52/220.2; 52/220.8; 52/220.1

[58] Field of Search ..... 52/220.2, 220.8, 52/220.1, 712; 29/897.3, 897.31, 897.312, 897.32, 432, 432.1

[56] References Cited

U.S. PATENT DOCUMENTS

| | | | |
|---|---|---|---|
| 3,240,869 | 3/1966 | Jureit | 52/220.1 X |
| 3,841,195 | 10/1974 | Jureit | 29/432 X |
| 3,949,465 | 4/1976 | Wirch | 29/432 |
| 4,224,731 | 9/1980 | Lingle | 29/432 |
| 4,578,914 | 4/1986 | Staples | 52/220.2 |
| 4,856,244 | 8/1989 | Clapp | 52/220.1 |
| 5,287,665 | 2/1994 | Rath, Jr. | 52/220.8 |
| 5,465,548 | 11/1998 | Niese | 29/897.3 X |
| 5,953,883 | 9/1999 | Ojala | 52/220.1 X |

*Primary Examiner*—Carl D. Friedman
*Assistant Examiner*—Phi Dieu Tran A
*Attorney, Agent, or Firm*—Marshall & Melhorn

[57] ABSTRACT

A individual, unattached framing stud comprises a wooden, elongate framing member having at least one through-hole for receiving a service line, such as electrical wiring. A metal safety or protective plate is preferably secured to a side edge of the framing member at a position transverse to the through-hole, so as to prevent the penetration of fasteners or the like which might otherwise damage the service line received in the through-hole. The framing stud is constructed by forming at least one through-hole in the framing member and securing the safety plate in position prior to affixing the framing stud within the frame of the structure.

3 Claims, 1 Drawing Sheet

FRAMING STUD AND METHOD OF MAKING THE SAME

BACKGROUND OF THE INVENTION

1. Field of the Invention

The invention relates generally to framing studs and, more particularly, to an improved wood framing stud especially for use in the construction of residential structures.

2. Summary of Related Art

Framing studs are well known devices employed in the construction industry to form a frame for the structure being built. Sheeting material is then secured to the frame to form both the exterior and interior walls of the structure. To form the interior walls, it is conventional to secure drywall or the like to the framing studs with nails, screws or the like.

It is customary, especially in residential construction, to utilize wooden framing studs, typically 2×4s or 2×6s of a selected length. There is generally a framing crew which cuts and joins a plurality of the elongate, wooden framing studs to construct the frame of the house. Sometimes, the framing studs have been pre-cut to the selected length prior to delivery to the construction site, to reduce the on-site time and labor required to construct the frame.

Once the entire structure has been framed, it is conventional for an electrician to drill holes in many of the framing studs through which the electrical wiring needed to service the structure is fed. Similar holes may also have to be formed at this stage of construction to accommodate other service lines, such as plumbing, cable, telephone lines, and the like.

Typically, once the rough service lines have all been installed, a drywalling crew will attach metal safety plates to the framing studs which carry the electrical wiring, and perhaps those carrying the other service lines. These safety plates are aligned transversely with the holes receiving the service lines, and are of sufficient structural strength to prevent penetration of the services lines by the fasteners used to attach the sheeting to the frame.

The drywallers generally use hammers or the like to force one or more projections extending from the safety plates into the studs. This commonly leaves the safety plate extending outwardly beyond the surface of the framing stud. However, it is desirable to have the safety plate flush with the framing stud to provide a smooth surface for securing the drywall. One solution to this problem has been to form a notch in the framing stud in which the safety plate is received, such as that shown in U.S. Pat. No. 3,689,681. However, forming such notches adds an additional labor intensive step to the on-site construction process.

It would therefore be desirable to provide an improved wood framing stud which is easy to use and which eliminates many of the on-site operations required with conventional wood framing studs.

SUMMARY OF THE INVENTION

This invention relates to a wood framing stud for use in forming the frame of a structure and a method of producing the same. The framing stud of the invention comprises an unattached wooden, elongate framing member having a substantially rectangular cross section. The term "unattached" is used herein to describe a framing member which has not yet been secured to another framing member or support. At least one through-hole is provided in the framing member for receiving a service line, such as electrical wiring. In a preferred embodiment, a pair of through-holes is provided in the framing member, one proximate each end.

A metal safety or protective plate is preferably secured to a side edge of the unattached framing member at a position transverse to the through-hole, so as to prevent the penetration of fasteners or the like which might otherwise damage the service line received in the through-hole.

In accordance with another aspect of the invention, the framing stud is formed by providing an elongate wooden framing member having a substantially rectangular cross section. Prior to affixing the framing stud to another framing element, at least one through-hole is formed therein at a predetermined point along the length of the framing member. In a preferred embodiment, such holes are formed in a plurality of the framing members simultaneously by means of a drill press or the like.

A metal safety or protective plate is secured to a side edge of the framing member at a position transverse to the longitudinal axis of the through-hole. The safety plate serves to protect the service lines which might be introduced into the through-hole during construction of a structure, such as a house. In a preferred embodiment, the safety plate is positioned on the framing member in a press, which is then operated to force the safety plate into the framing member. As a result, the safety plate is flush with the surface of the framing member to thereby facilitate packing of the framing members for shipping, as well as to facilitate the subsequent mounting of sheeting material, such a drywall, to the framing member. In a most preferred embodiment, a plurality of the framing members are mounted with associated safety plates in a press, which is then operated to simultaneously press the safety plates into the associated framing member.

If the framing members are not already at the desired length, they may be cut to the desired length at any point in the process of the invention.

In a preferred embodiment of the method of the invention, a plurality of the framing members are mounted in a press with any desired safety plates positioned relative to the associated framing members at locations transverse to the locations selected for the subsequent formation of through-holes. The press is operated to press the safety plates into the associated framing members. Then, with the framing members still secured by the press, the one or more through-holes are formed therein and, if desired, the framing members are cut to the required length. The press is then retracted to release the framing members.

BRIEF DESCRIPTION OF THE DRAWINGS

The above, as well as other advantages of the present invention, will become readily apparent to those skilled in the art from the following detailed description of a preferred embodiment when considered in the light of the accompanying drawings in which.

DESCRIPTION OF THE PREFERRED EMBODIMENTS

Figure 1:
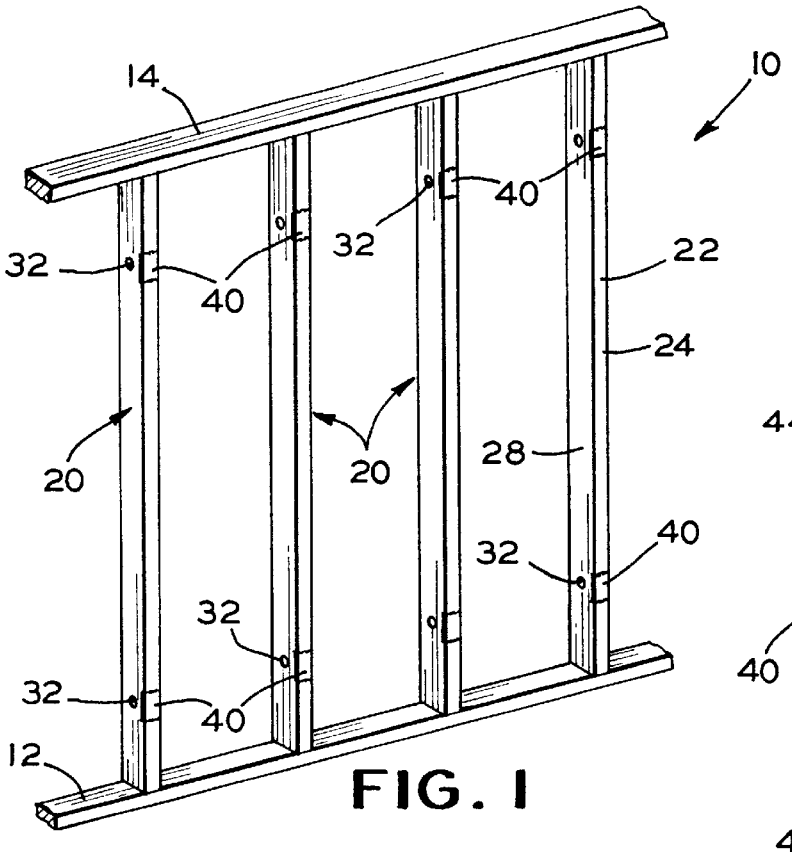
FIG. 1 is a perspective view of a plurality of the framing studs of the invention after assembly as a vertical wallof a structure.

Referring now to the drawings, there is illustrated in FIG. 1 a wall assembly, indicated generally at 10, formed in accordance with this invention. The wall assembly 10 illustrated in FIG. 1 includes a generally horizontally disposed footer 12 and header 14, with a plurality of the framing studs 20 of the invention secured therebetween, typically by nailing. The wall assembly 10 has been shown in FIG. 1 immediately after the footer 12, header 14 and individual framing members 20 have been secured together; that is, prior to the framing members 20 being subjected to any further operation.

The individual framing studs 20 more specifically include an elongate framing member 22 formed of wood. The framing member 22 has a rectangular cross section defining four elongate side edges: an interior edge 24 with an opposed exterior edge 26, and a left side edge 28 with opposed right side edge 30. The framing members 22 may be the customary 2×4, 2×6, or any other size of wooden framing lumber. The framing members 22 may be of whatever length is desired for the height of the wall assembly 10 of the structure.

The framing stud 20 further includes at least one through-hole 32 extending from the left side edge 28 to the right side edge 30 of the framing member 22. The through-hole 32 is adapted to receive one or more service lines (not shown), especially the electrical wiring, after framing.

The hole 32 may be formed at any desired point along the length of the framing member 22. Holes 32 adapted to receive electrical wiring are commonly positioned about 2 feet from what, after framing, becomes the lower end of the framing stud 20. Preferably, the holes 32, in what are intended to be adjacent framing studs 20, are formed at about the same position along the length of the respective framing members 22.

Of course, additional through-holes may be formed in the framing members 22 of the studs 20, if desired, to receive additional electrical wiring, cable, telephone lines, plumbing or the like. Moreover, in the preferred embodiment illustrated in FIG. 1, a through-hole 32 is formed proximate each end of the framing member 22. In this embodiment, it is further preferred that the noted pair of through-holes 32 are positioned an equal distance from the nearest end, respectively, of the framing member 22. With such a configuration, the framing members 22 are able to be used by framers in constructing the frame of a structure without requiring that a particular end of the framing member 22 be positioned adjacent the floor.

Figure 2:
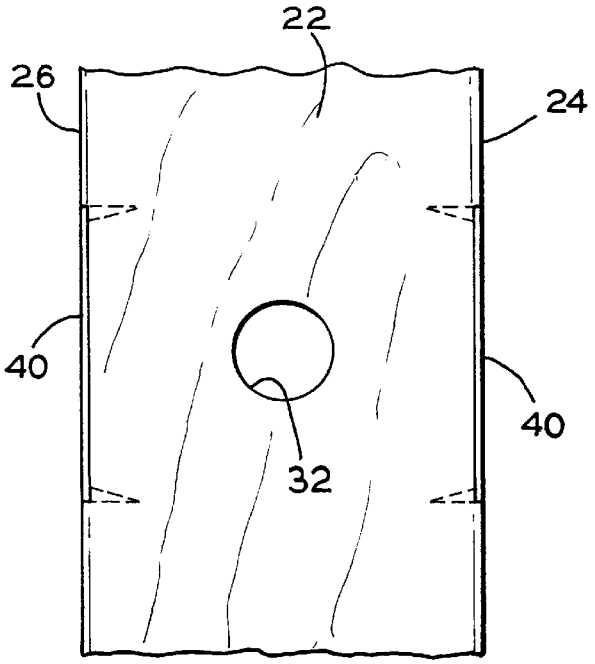
FIG. 2 is an enlarged plan view of a portion of a framing stud in accordance with the invention.
Figure 3:
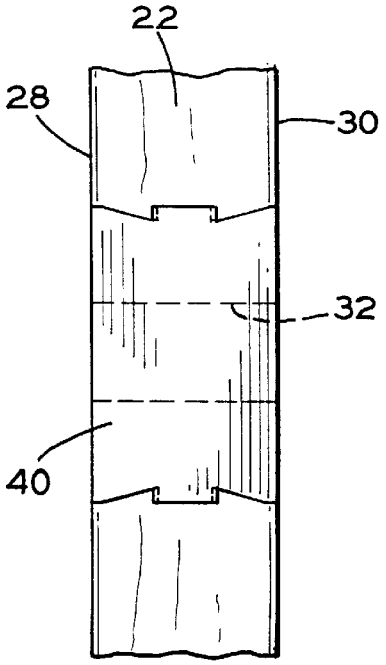
FIG. 3 is an enlarged plan view of the framing stud shown in FIG. 2.

The framing stud 20 of the invention also preferably includes one or more safety or protective plates 40 secured to the framing member 22 prior to framing. A safety plate 40 is secured to the interior edge 24 of the framing member 22, the opposed exterior edge 26 of the framing member 22, or both (as shown in FIG. 2). The safety plate(s) 40 are thus positioned transverse to the longitudinal axis of the associated through-hole 32.

The safety plate(s) 40 are formed of a material, preferably a metal such as steel, which has sufficient strength to prevent penetration by the typical fasteners, such as nails, screws and the like. The safety plates 40 thereby prevent damage to the service lines received in the through-holes 32 which might otherwise result from penetration by the fasteners used during construction to secure sheeting material or the like to either the interior or exterior edges 28,30 of the framing member 22, or after construction to mount various items to the wall assembly 10.

Figure 4:
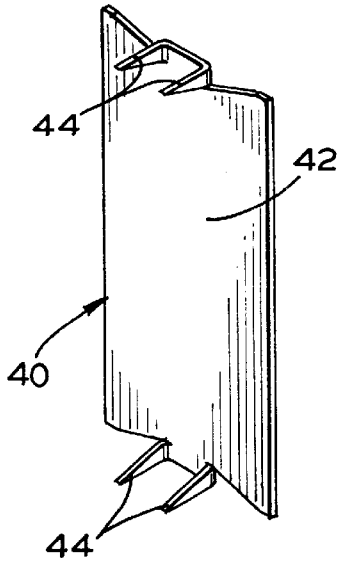
FIG. 4 is a perspective view of the protective plate shown in FIGS. 2 and 3.

The safety plate 40 may be of any suitable construction which provides protection to the service lines and which may be secured to the framing member 22, preferably with a flush finish. In the illustrated embodiment, best seen in FIG. 4, the safety plate 40 is formed of a stamped metal piece including a main body portion 42 and a pair of tapered attachment projections 44 formed at each of two opposed ends thereof.

In accordance with another aspect of the invention, the framing stud 20 of the invention is formed by providing an elongate wooden framing member 22 having a substantially rectangular cross section. Prior to affixing the framing member 22 to any other portion of the frame, at least one through-hole 32 is formed therein at a predetermined point along the length of the framing member 22 which extends from the left side 28 to the right side 30 thereof. In a preferred embodiment, the holes 32 are formed in a plurality of the framing members 22 simultaneously by means of a drill press or the like, wherein the plurality of framing members 22 are aligned and mounted one on top of the next.

A safety or protective plate 40 is advantageously secured to the interior edge 24 or exterior edge 26 of the framing member 22, or both, at a position transverse to the longitudinal axis of the associated through-hole 32. As discussed above, the safety plate 40 serves to protect the service lines which might be introduced into the through-hole 32 during construction. The safety plate 40 may be secured to the framing member 22 either before or after formation of the associated through-hole 32.

In a preferred embodiment, the safety plate 40 is positioned on the framing member in a press, which is then operated to force the safety plate into the framing member. As a result, a mortise is essentially formed and the safety plate 40 is flush with the surface of the framing member. This flush surface is important for the packaging of the pre-formed framing studs 20 of the invention, and is also advantageous in that drywall or the like may be more readily mounted to such a flush surface after framing.

In a further preferred embodiment, a plurality of the framing members 22 are mounted with the associated safety plates 40 in a press. The press is then operated to simultaneously press the safety plates 40 into the associated framing member 22, securely affixing the two together and resulting in a flush surface.

If the framing members 22 of the framing studs 20 are not already at the desired length, they may be cut to the desired length at any point in the process of the invention. A plurality of the framing members are preferably cut simultaneously prior to the formation of the through-hole 32 or attachment of the safety plate 40.

In a most preferred embodiment of the method of the invention, a plurality of the framing members 22 are mounted in a press with any desired safety plates 40 positioned relative to the associated framing members 22 at locations transverse to the locations selected for the subsequent formation of the through-holes 32. The press is operated to press the safety plates 40 into the associated framing members 22 in much the same manner as described above. Then, with the framing members 22 still secured by the press, the one or more through-holes 32 are formed therein, again in much the same manner as described above. If desired, the framing members 22 are also cut to the required length. The press is then retracted to release the framing members 22.

The individual, unattached framing studs 20 in accordance with invention, having at least one through-hole 32 and preferably an associated safety plate mounted thereto, may be readily employed to construct a wall assembly 10, such as that shown in FIG. 1. The framing studs 20 are secured to a conventional footer 12 and header 14 in the known manner to form the frame. Advantageously, however, the wall assembly 10 is immediately ready upon its formation to receive the electrical wiring or other service lines. Thus, on-site drilling of the holes required to receive such service lines is not required. Similarly, the drywall crew need not take the time to secure safety plates to the framing members to protect the service lines. As a result, the framing studs of the invention reduce the time and expense required to construct a wood framed structure on-site.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. A method of forming a plurality of framing studs for subsequent use in forming the frame of a structure, comprising:

providing a plurality of elongate, wooden framing members, each having a substantially rectangular cross section defining four elongate side edges; and prior to affixing said framing studs as part of the frame of the structure:

mounting each of said framing members in stacked relationship in a press;

positioning a protective plate along a side edge of each of the framing members;

operating the press to force each of the protective plates into the side edge of the associated framing member to secure the two together;

while the framing members are still secured by the press, forming at least one hole in each of said framing members, each of said holes extending from a first one of said side edges through to the opposite side edge of the respective framing member and defining a longitudinal axis which is transverse to the position of an associated one of said protective plates; and releasing the framing members from the press.

2. A method as defined in claim 1, further comprising cutting said framing members to a predetermined length prior to releasing the framing members from the press.

3. A method as defined in claim 1, wherein said holes are formed in said framing members by a drill press.

* * * * *